US009728856B2

(12) United States Patent
Foo

(10) Patent No.: US 9,728,856 B2
(45) Date of Patent: Aug. 8, 2017

(54) DUAL-POLARIZED DUAL-BAND BROAD BEAMWIDTH DIRECTIVE PATCH ANTENNA

(71) Applicant: Intel Corporation, Santa Clara, CA (US)

(72) Inventor: Senglee Foo, Irvine, CA (US)

(73) Assignee: Intel Corporation, Santa Clara, CA (US)

( * ) Notice: Subject to any disclaimer, the term of this patent is extended or adjusted under 35 U.S.C. 154(b) by 166 days.

(21) Appl. No.: 13/934,953

(22) Filed: Jul. 3, 2013

(65) Prior Publication Data

US 2014/0159979 A1 Jun. 12, 2014

Related U.S. Application Data

(63) Continuation of application No. 12/754,453, filed on Apr. 5, 2010, now abandoned.

(60) Provisional application No. 61/167,097, filed on Apr. 6, 2009.

(51) Int. Cl.

| | |
|---|---|
| ***H01Q 9/04*** | (2006.01) |
| ***H01Q 15/18*** | (2006.01) |
| ***H01Q 5/42*** | (2015.01) |

(52) U.S. Cl.

CPC ..... *H01Q 9/0414* (2013.01); *H01Q 5/42* (2015.01); *H01Q 15/18* (2013.01)

(58) Field of Classification Search

CPC ..... H01Q 9/0414; H01Q 5/42; H01Q 15/18
See application file for complete search history.

(56) References Cited

U.S. PATENT DOCUMENTS

| | | | | |
|---|---|---|---|---|
| 6,295,028 | B1 * | 9/2001 | Jonsson et al. | 343/700 MS |
| 7,068,222 | B2 * | 6/2006 | Koparan | H01Q 1/246 343/700 MS |
| 7,701,409 | B2 | 4/2010 | Slattman et al. | |
| 7,808,443 | B2 | 10/2010 | Lindmark et al. | |
| 2007/0139278 | A1 * | 6/2007 | Slattman | H01Q 1/246 343/700 MS |
| 2010/0283707 | A1 | 11/2010 | Foo | |

OTHER PUBLICATIONS

Balanis, Constantine A., Antenna Theory: A Review, Proc. IEEE vol. 80 No. 1 Jan. 1992.*
"U.S. Appl. No. 12/754,453, Non Final Office Action mailed Jun. 4, 2012", 15 pgs.
"U.S. Appl. No. 12/754,453, Response filed Sep. 27, 2012 to Non Final Office Action mailed Jun. 4, 2012", 17 pgs.

* cited by examiner

*Primary Examiner* — Robert Karacsony
*Assistant Examiner* — Amal Patel
(74) *Attorney, Agent, or Firm* — Schwegman Lundberg & Woessner, P.A.

(57) ABSTRACT

An antenna architecture with a dual-band patch antenna structure having a broadened low-frequency beamwidth is disclosed. The dual band antenna structure comprises a high frequency patch antenna cavity stacked inline above a low frequency patch antenna cavity. An N-shaped metallic wall surrounds the low frequency patch antenna cavity and broadens the emission radiation beamwidth of the low frequency emission. As such, these dual band antenna structures can emit radiation with a beamwidth of approximately 90 degrees in the low frequency band of 700 MHz to 900 MHz as well as the high frequency band of 1.7 GHz to 2.2 GHz.

14 Claims, 9 Drawing Sheets

DUAL-POLARIZED DUAL-BAND BROAD BEAMWIDTH DIRECTIVE PATCH ANTENNA

RELATED APPLICATION INFORMATION

The present application claims priority under 35 USC Section 119(e) to U.S. provisional patent application Ser. No. 61/167,097 filed Apr. 6, 2009, the disclosure of which is incorporated herein by reference in its entirety.

BACKGROUND OF THE INVENTION

1. Field of the Invention

The present invention relates to radio communication antenna systems for wireless networks. More particularly, the invention is directed to active array antennas and related methods.

2. Description of the Prior Art and Related Background Information

Modern wireless antenna systems generally include a plurality of radiating elements that may be arranged over a ground plane defining a radiated (and received) signal beamwidth and azimuth angle. Antenna beamwidth has been conventionally defined by Half Power Beam Width ("HPBW") of the azimuth or elevation beam relative to a bore sight of such antenna element.

Real world applications often call for an antenna radiating element with frequency bandwidth, pattern beamwidth and polarization requirements that may not be possible for conventional antenna radiating element designs to achieve due to overall mechanical constraints.

Currently, there is a demand for cellular base station antennas that produces 90 degree azimuth beamwidth at two separate frequency bands, i.e., 1.7 GHz-2.2 GHz and 700 MHz to 900 MHz. Conventional techniques to broaden the emission beamwidth include employing metallic and dielectric shrouds. These techniques are effective for broadening the beamwidth for high frequency bands (1.7 GHz-2.2 GHz); however, these techniques are either not effective or are difficult to implement at frequencies below 1 GHz. At lower frequencies (i.e., longer wavelength), the thickness of the dielectric shroud becomes impractically large to achieve the beam broadening effect. Moreover, simple thin-wall metallic shrouds becomes resonant, thus reducing the frequency bandwidth.

Accordingly, a need exists for an improved antenna element architecture which allows a dual-polarized dual-band broad beamwidth antenna.

SUMMARY OF THE INVENTION

In a first aspect the present invention provides an antenna radiating structure comprising a first patch radiating element, a second patch radiating element configured above and spaced apart from the first patch radiating element in a radiating direction, and a metallic perimeter structure, configured around the edges of the first and second patch radiating elements. The metallic perimeter structure comprises at least first, second and third wall sections extending generally in the radiating direction wherein at least two of the wall sections are angled relative to each other.

In a preferred embodiment of the antenna radiating structure the metallic perimeter structure is recessed from the top surface of the second patch radiating element. The third wall section preferably extends further in the radiating direction than the first and second wall sections. The first wall section is preferably configured with one end positioned in close proximity to the first patch radiating element and with the other end extending in the radiating direction and oriented away from the first patch radiating element. The second wall section is preferably configured with one end coupled to the first wall section and the other end oriented generally away from the radiating direction. The third wall section is preferably configured with one end coupled to the second wall and the other end oriented generally in the radiating direction. The metallic perimeter structure in cross section is preferably approximately in the shape of the letter "N" to form a continuous N-shaped wall. The first patch radiating element preferably has a planar surface with a surface normal perpendicular thereto and at least one of the wall sections has a planar surface oriented at an angle of a few degrees relative to the surface normal of the first patch radiating element. The first and third wall sections preferably each have a planar surface oriented at an angle of a few degrees relative to the surface normal of the first patch radiating element and oriented away from the first patch radiating element and the second wall section preferably has a planar surface oriented at an angle of a few degrees relative to the surface normal of the first patch radiating element and oriented toward the first patch radiating element. The planar surfaces of the first and second wall sections may be substantially parallel. The N-shaped wall comprising the metallic perimeter structure preferably has four sides around the perimeter of the first patch radiating element, wherein the length of each side of the N-shaped wall measured in the direction parallel to the surface of the patch radiating element is approximately one half of the radiation emission wavelength. The antenna radiating structure preferably further comprises a metallic partial enclosure having a cavity containing the first and second patch radiating elements and wherein the height of the N-shaped wall in the radiating direction is in the range of approximately 0.5 to approximately 0.75 of the distance of the first patch radiating element above the bottom of the cavity. In one embodiment the radiation emission is in the range of approximately 700 MHz to approximately 900 MHz.

In another aspect the present invention provides an antenna radiating structure comprising a low-frequency patch antenna structure, a high-frequency patch antenna structure, wherein the high-frequency patch antenna structure is positioned above the low frequency patch antenna structure in a radiating direction, and a metallic perimeter structure, configured around the edges of the low-frequency patch antenna structure, the metallic perimeter structure including one or more walls oriented at an angle to the radiating direction.

In a preferred embodiment of the antenna radiating structure the high-frequency patch antenna structure comprises a first high-frequency generally planar radiating element and a second high-frequency generally planar radiating element configured above and spaced apart from the first high-frequency generally planar radiating element in the radiating direction. The low-frequency patch antenna structure preferably comprises a first low-frequency generally planar radiating element and a second low-frequency generally planar radiating element configured above and spaced apart from the first low-frequency generally planar radiating element in the radiating direction. The metallic perimeter structure is preferably configured below the top surface of the second high-frequency generally planar radiating element. The metallic perimeter structure preferably comprises at least first, second and third wall sections extending generally in the radiating direction wherein at least two of the wall sections are angled relative to each other. The metallic perimeter is preferably approximately in the shape of the letter "N" to form an N-shaped wall. The antenna radiating structure preferably further comprises a metallic partial enclosure having a high-frequency cavity containing the first and second high-frequency generally planar radiating elements and a low-frequency cavity containing the first and second low-frequency generally planar radiating elements, wherein the high-frequency cavity extends partially into the low-frequency cavity. In one embodiment the radiation emission in the low-frequency band is in the range of approximately 700 MHz to approximately 900 MHz and the radiation emission in the high-frequency band is in the range of approximately 11 GHz to 2.2 GHz.

In another aspect the present invention provides an antenna array comprising a ground plane and first and second dual band antenna structures coupled to the ground plane. Each of the first and second dual band antenna structures comprises a low-frequency patch antenna structure, a high-frequency patch antenna structure positioned above the low frequency patch antenna structure in a radiating direction, and a metallic perimeter structure configured around the edges of the low-frequency patch antenna structure and including one or more walls oriented at an angle to the radiating direction. The antenna array further comprises a high band antenna structure configured on the ground plane between the first and second dual band antenna structures.

Further features and aspects of the invention are set out in the following detailed description.

DETAILED DESCRIPTION OF THE INVENTION

It is an object of the present invention to provide dual-band antennas that emit radiation having a broad beamwidth while achieving a large frequency bandwidth of operation. The disclosed antenna structure produces broad radiation patterns with typical half power beamwidth of 90 degrees in the azimuth direction at two separate frequency bands with low cross-polarized field components.

Figure 1A:
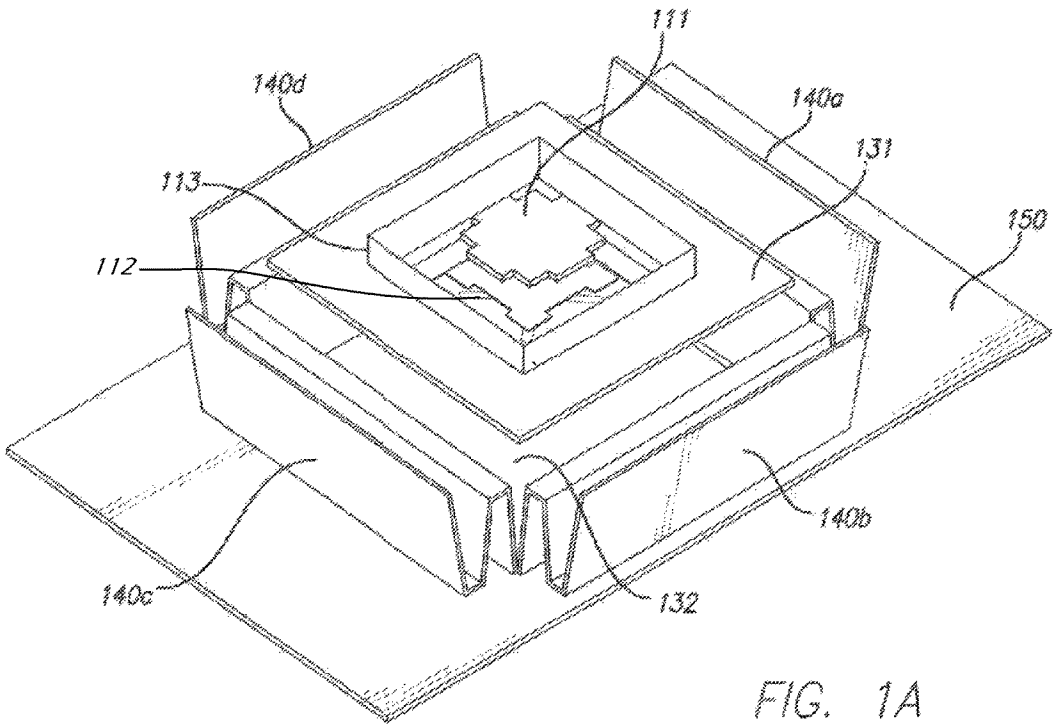
FIG. 1A is a top view of the dual-band dual-polarized broad beamwidth radiator in accordance with an embodiment of the present invention.
Figure 1B:
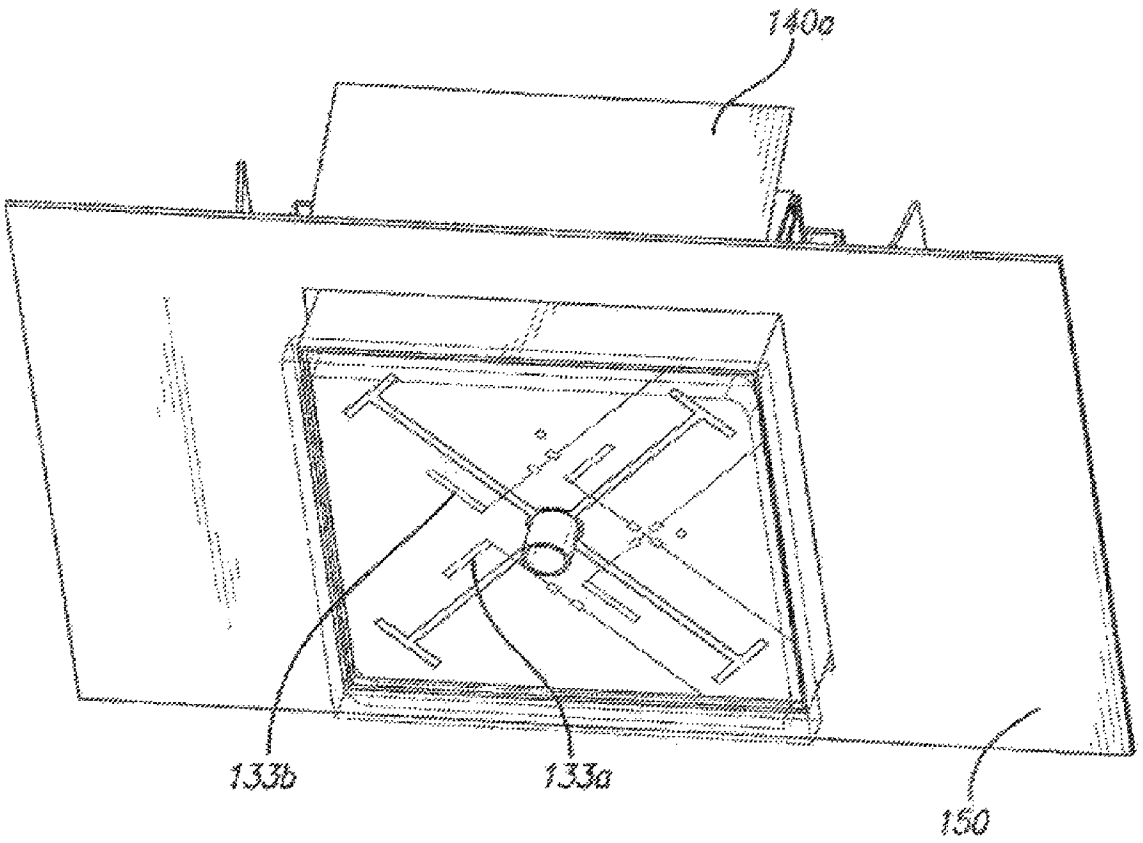
FIG. 1B is a bottom view of the dual-band dual-polarized broad beamwidth radiator in accordance with an embodiment of the present invention.
Figure 2A:
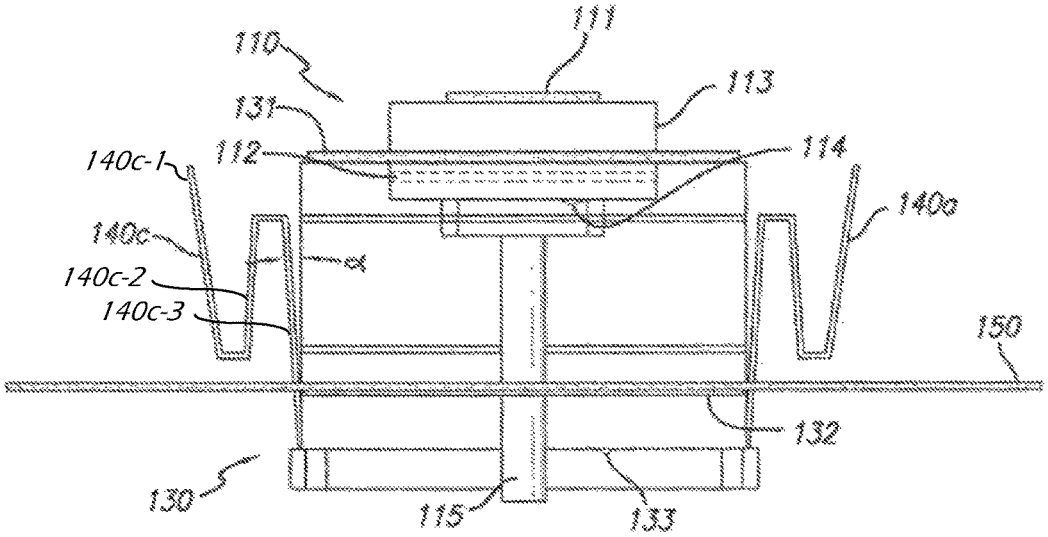
FIG. 2A is a cross section side view of the dual-band dual-polarized broad beamwidth radiator in accordance with an embodiment of the present invention.
Figure 2B:
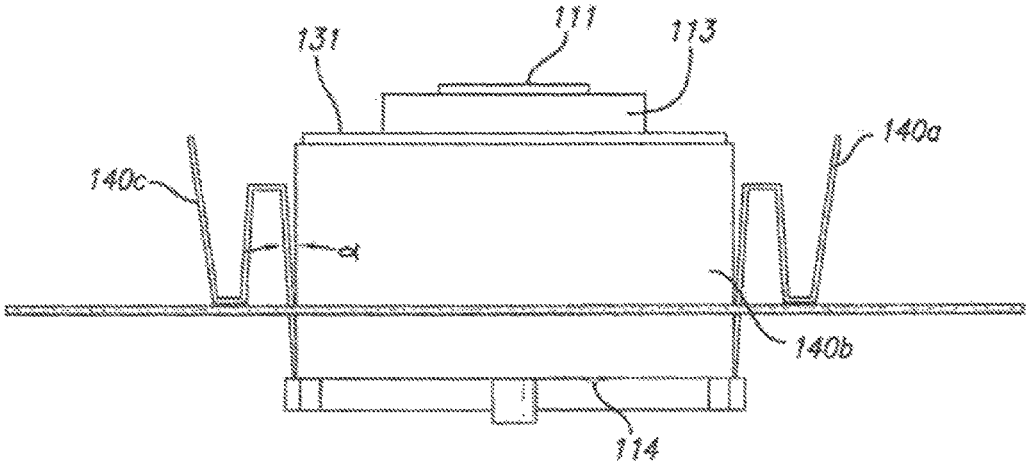
FIG. 2B is a side view of the dual-band dual-polarized broad beamwidth radiator in accordance with an embodiment of the present invention.

In an embodiment of the present invention, a dual-band antenna structure comprises a high frequency patch antenna cavity stacked inline above a low frequency patch antenna cavity. Both the high frequency patch antenna and the low frequency patch antenna employ two patches in order to achieve a wide frequency bandwidth that is typically 25% of the emission frequency. In a preferred embodiment, a four-sided N-shaped metallic wall surrounds the low frequency patch antenna cavity and broadens the emission radiation beamwidth of the low frequency emission. As such, these dual band antenna structures can emit radiation with a beamwidth of approximately 90 degrees in the low frequency band of 700 MHz to 900 MHz as well as the high frequency band of 1.7 GHz to 2.2 GHz. The beamwidth of the low frequency emission is enhanced by tailoring the height of the N-shaped metallic wall and by tilting the N-shaped wall. The invention provides a low-frequency stacked patch structure which generates a broad radiation beamwidth over a large frequency bandwidth of operation FIGS. 1A and 1B present the top and bottom perspective views of the dual-band dual-polarized broad beamwidth radiator in accordance with an embodiment of the present invention. FIGS. 2A and 2B are side views which illustrate the dual-band antenna structure having a High-Band Cavity 110 stacked inline above a Low Band Cavity 130. In one or more embodiments of the invention, both Low-Band Cavity 130 and High-Band Cavity 110 incorporate dual 30 patch radiators. Both cavities therefore include a first generally planar patch radiating element and a second generally planar patch radiating element for radiative coupling to the first generally planar patch radiating element. A metallic perimeter surrounds Low-Band Cavity 130 and acts to broaden the beamwidth of the Low-Band radiation. In an embodiment of the present invention, four N-Shaped Walls 140*a*-140*d* comprise a partial metallic enclosure surrounding the outer perimeter of the Low-Band Cavity. In the illustrative non-limiting implementations shown, the low-band and high-band cavities each incorporate aperture coupled radiating elements. However, it shall be understood that alternative low-band and high-band radiator implementations can be employed as well.

In an embodiment, the Low-Band radiator structure configured in Low-Band Cavity 130 comprises Low-Band Feeds 133, Low-Band Lower Patch 132, and Low-Band Top Patch 131. Low-Band Feeds 133 are positioned in the bottom section of Low-Band Cavity 130 and are configured to feed microwave energy into the Low-Band Cavity 130. Low-Band Feeds 133 may comprise one or more micro strip lines configured on a dielectric sheet in an embodiment. Low-Band Lower Patch 132 preferably comprises an electrically conductive plane having an aperture for radiative coupling with Low-Band RF energy fed via Low-Band Feeds 133. The aperture may be cross-shaped or otherwise configured to generate a dual polarized microwave beam. Low-Band Top Patch 131 is spaced above Low-Band Lower Patch 132 and serves as a secondary radiating patch. In an embodiment of the present invention, Low-Band Top Patch 131 is centrally disposed on a dielectric substrate; however, other configurations are also possible.

In an embodiment of the present invention, High-Band Cavity 110 is configured inline and above Low-Band Cavity 130 and comprises High-Band Feeds 114, High-Band Low Patch 112, and High-Band Top Patch 111. High-Band Feeds 114 are positioned in the bottom section of High-Band Cavity_110 and are coupled with High-Band Cable Shield 115 to feed microwave energy into the 30 High-Band Cavity 110. High-Band Feeds 114 may comprise one or more micro strip lines configured on a dielectric sheet in an embodiment of the present invention. High-Band. Lower Patch 112 comprises an electrically conductive plane for radiative coupling with High-Band RF energy fed via High-Band Feeds 114. The conductive plane may include an aperture which may be cross-shaped or otherwise configured to generate a dual polarized microwave beam. High-Band Top Patch 111 is configured above High-Band Lower Patch 112 and serves as a secondary radiating patch. As depicted in FIG. 1 A, an aperture in Low-Band Top Patch 131 enables High-Band Top Patch 111 to be radioactively coupled with High-Band Lower Patch 112 and High-Band Top Patch 111. High Band Shroud 113 surrounds High-Band. Cavity 110 and is partially recessed under the 10 surface of High-Band Top Patch 111.

A metallic perimeter surrounds Low-Band Cavity 130. In an embodiment of the present invention, four N-Shaped Walls 140*a*-140*d* surround Low-Band Cavity 130. That is, viewed in the side section views of FIGS. 2A and 2B, each of the walls has three sections 140*c*-1, 140*c*-2 and 140*c*-3, extending vertically (generally in the radiating direction) and are angled with respect to the vertical and each other. Stated differently, the N-Shaped Walls 140*a*-140*d* are configured to have a tilt angle α with respect to the surface normal of the Low-Band Lower Patch. 132 and Low-Band Top Patch 111 (i.e., the direction normal to the plane of Lower Band Patch 132). The N-shaped Walls 140*a*-140*d* provide a broad beamwidth over a relatively large frequency bandwidth. The minimum length of the N-Shaped Walls 140*a*-140*d* should be comparable to one half of the wavelength of frequency of operation to be effective. The tilt angle α and the height of the N-Shaped Walls 140*a*-140*d* may be tailored to achieve broad emission beamwidth and frequency bandwidth. For example, increasing the height of the N-Shaped Walls 140*a*-140*d* broadens the emission beamwidth; however, increasing the height of the N-Shaped Walls 140*a*-140*d* also tends to reduce the overall frequency bandwidth of the antenna. Furthermore, frequency bandwidth can be improved using a slight tilt on the N-Shaped Walls 140*a*-140*d*. However, too large of tilt angle α tends to reduce the beamwidth of the radiation patterns. Proper selection of these two parameters is radiating direction. The surface of the first section may be flat or contoured to achieve broad beamwidth and wide bandwidth. In the illustrated embodiment, the metallic structure may comprise a first section (as described above), a second section, and a third section. One end of the second section is coupled to the end of the first section positioned in a radiating direction and the other end of the second section is positioned away from Low-Band Cavity 130. One end of the third section is coupled to the end of the second section positioned away from the Low-Band Cavity 130 and the other end of the third section is positioned in a radiating direction. The surfaces of the first, second, or third sections may be flat, contoured, or a combination of flat and contoured to achieve broad beamwidth and wide bandwidth.

Simulations suggest that the optimum tilt angle α is in the order of a few degrees. The optimum height of the N-Shaped Walls 140*a*-140*d* is typically between 0.5 and 0.75 of the distance from the bottom of the cavity 130 and Low-Band Top Patch 131.

Figure 5:
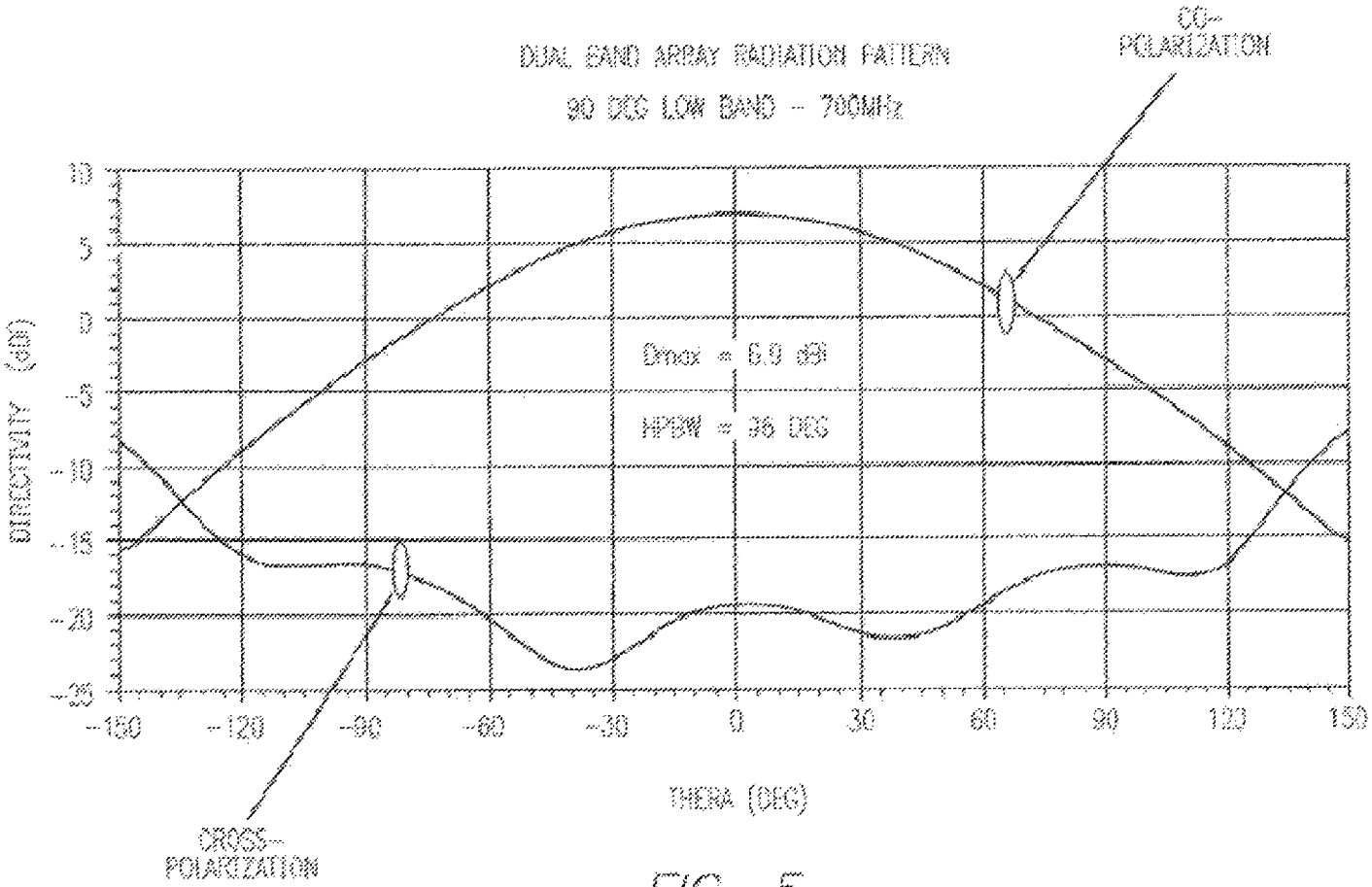
FIG. 5 is a representation of a simulated radiation pattern radiating at 700 MHz in accordance with an embodiment of the present invention.
Figure 6:
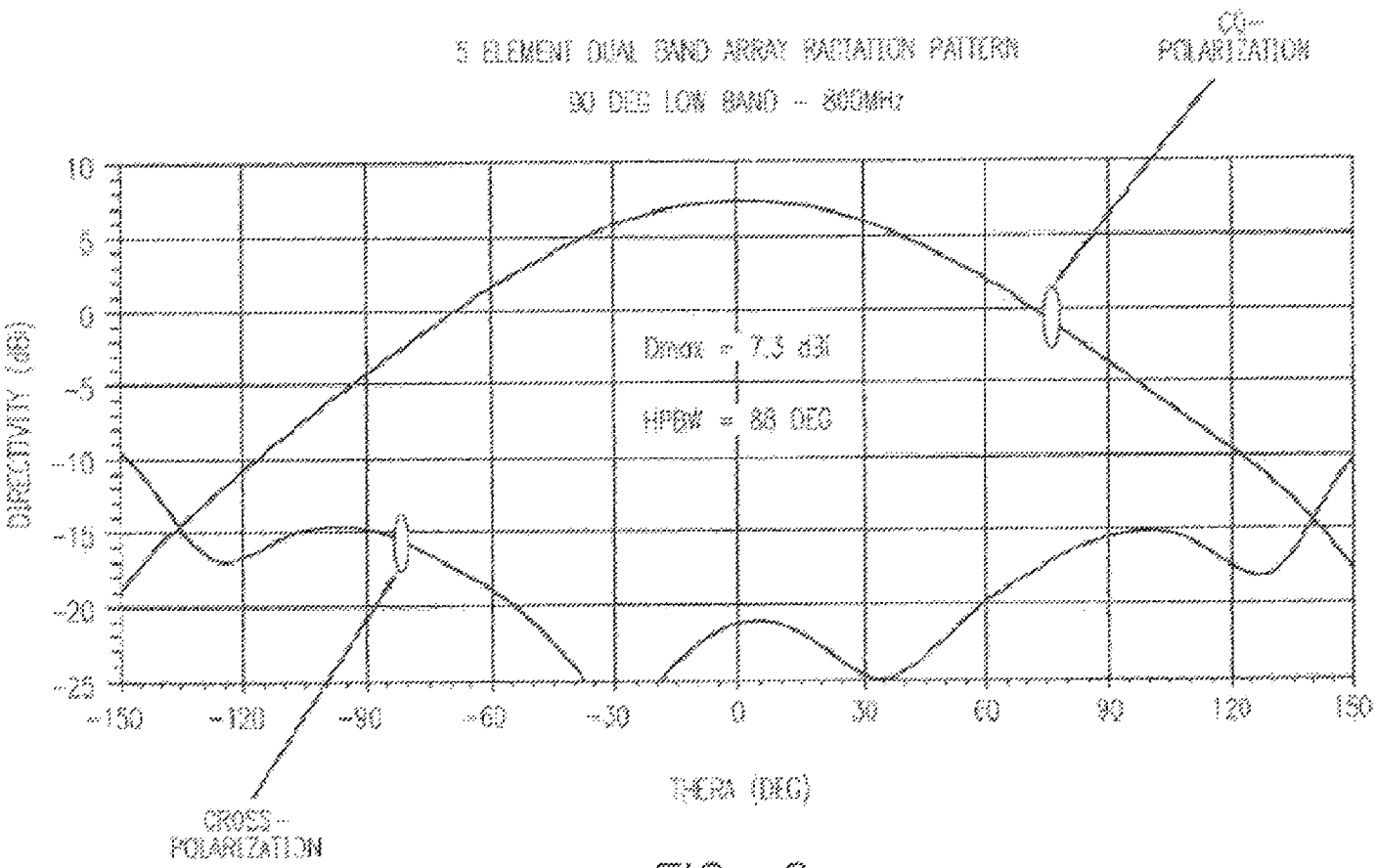
FIG. 6 is a representation of a simulated radiation pattern radiating at 800 MHz in accordance with an embodiment of the present invention.
Figure 7:
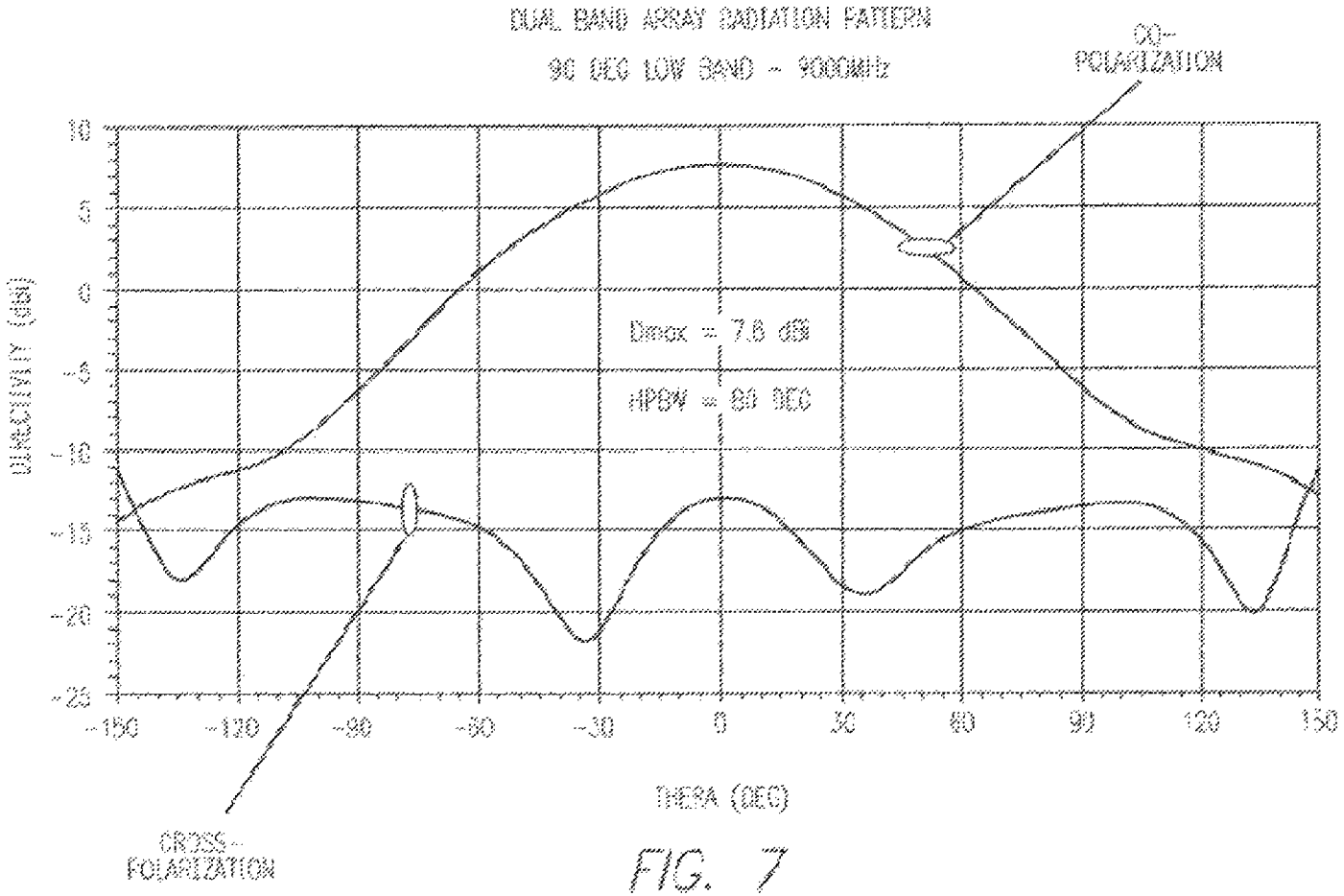
FIG. 7 is a representation of a simulated radiation pattern radiating at 900 MHz in accordance with an embodiment of the present invention.

FIGS. 5 to 7 show typical radiation patterns of the Low-Band Cavity 130 and indicate that the radiation beamwidth is between 80 degrees and 96 degrees over the frequency range of 700 MHz to 900 MHz. The cross-polarized field level is typically below −20 dB within the half-power beamwidth.

FIG. 5 is a representation of a simulated radiation pattern radiating at 700 MHz in accordance with an embodiment of the present invention. The top curve represents the co-polarization radiation and the bottom curve represents the cross-polarization radiation. This simulation suggests that the HPBW is 96 degrees. FIG. 6 is a representation of a simulated radiation pattern radiating at 800 MHz in accordance with an embodiment of the present invention. This simulation suggests that the HPBW for 800 MHz emission is 88 degrees. FIG. 7 is a representation of a simulated radiation pattern radiating at 900 MHz in accordance with an embodiment of the present invention, and suggests that the HPBW is 80 degrees.

In the illustrative non-limiting implementations shown, the metallic perimeter structure comprises four N-Shaped Walls 140*a*-140*d*. However, it shall be understood that many modifications including alternative number, shape, or placement of surfaces can be used as well. In the preferred illustrated embodiment, the metallic perimeter structure comprises a first section in which one end of the first section is positioned at the bottom of Low-Band Cavity 130 near Low-Band Feeds 133 with the other end of the first section positioned in a radiating direction. The surface of the first section may be flat or contoured to achieve broad beamwidth and wide bandwidth. In the illustrated embodiment, the metallic structure may comprise a first section (as described above), a second section, and a third section. One end of the second section is coupled to the end of the first section positioned in a radiating direction and the other end of the second section is positioned away from Low-Band Cavity 130. One end of the third section is coupled to the end of the second section positioned away from the Low-Band Cavity 130 and the other end of the third section is positioned in a radiating direction. The surfaces of the first, second, or third sections may be flat, contoured, or a combination of flat and contoured to achieve broad beamwidth and wide bandwidth.

Figure 3:
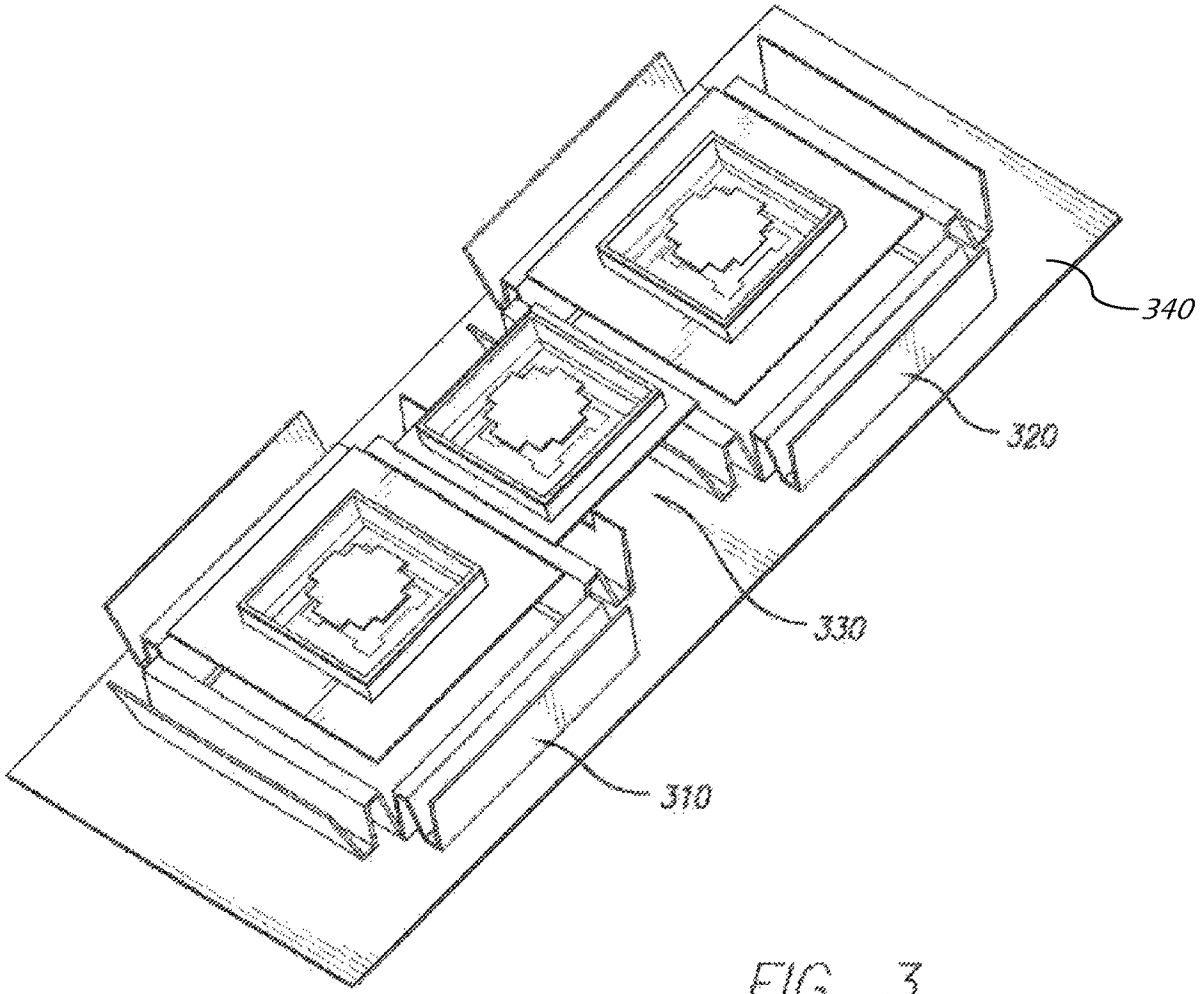
FIG. 3 is a top view of an antenna structure having two dual-band radiators and a single high-band radiator in accordance with an embodiment of the present invention.
Figure 4:
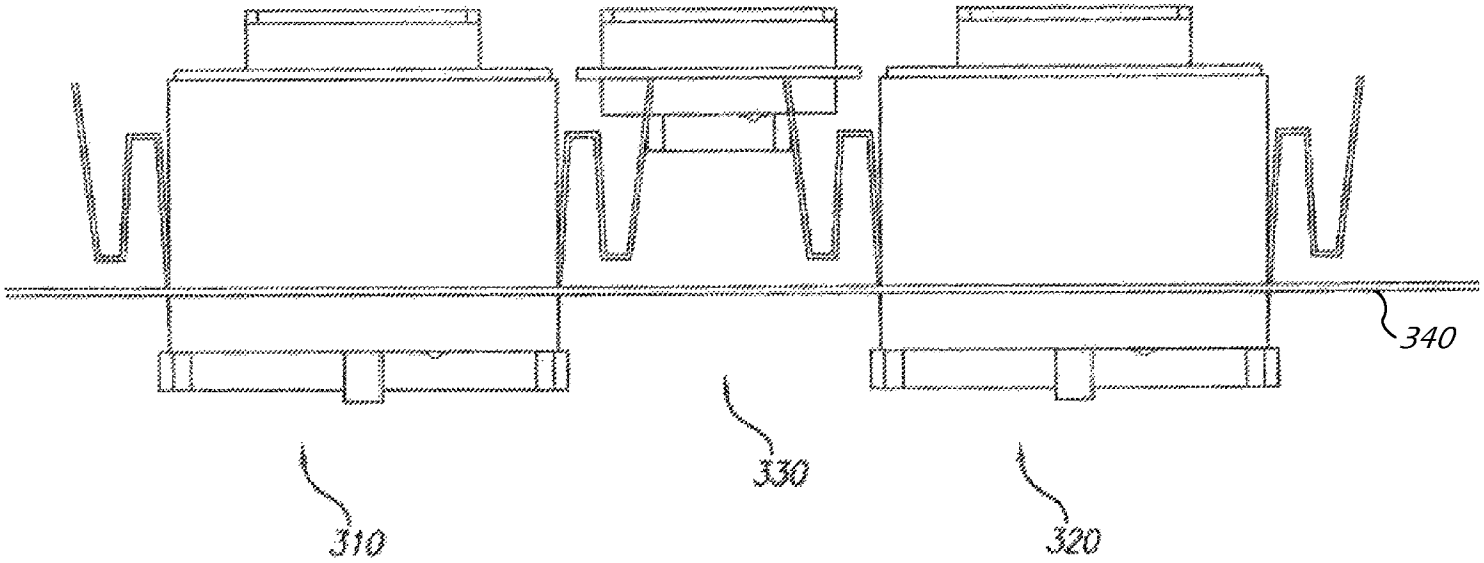
FIG. 4 is a side view of an antenna structure having two dual-band radiators and a single high-band radiator in accordance with an embodiment of the present invention.

FIGS. 3 and 4 shows an antenna array configuration using Dual-Band Antenna Structures 310 and 320 with one High-Band Antenna Structure 330 configured on a common ground plane 340 in an embodiment of the invention. This may be viewed as a single column array (or single row array, depending on orientation). It will be appreciated that additional columns and/or rows may be provided or additional Dual-Band or high band radiator structures in a given column (or row) may provided to provide a larger array. Dual-Band Antenna Structures 310 and 320 are preferably fabricated as separate modules and are attached to a main reflector structure to form the array. High-Band Antenna Structure 330 is positioned between Dual-Band Antenna Structures 310 and 321) to achieve the required High-Band radiation pattern in the elevation.

The present invention has been described primarily for providing a dual-band patch antenna structure having a broadened low-frequency beamwidth. In this regard, the foregoing description of an antenna structure is presented for purposes of illustration and description. Furthermore, the description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. A dual band antenna radiating structure, comprising:

a first high-band patch radiating element that comprises an electrically conductive plane for radiative coupling with high-band RF energy fed via at least one high-band feed located below the first high band patch radiating element;

a second high-hand patch radiating element comprising an electrically conductive plane configured above and spaced apart from said first high-band patch radiating element in a radiating direction, the second high-band patch radiating element comprising a secondary radiating patch;

a first low-band patch radiating element comprising an electrically conductive plane configured between the first high-band patch and the second high-band patch, the low-band patch radiating element including an aperture that enables the second high-band radiating element to be radiatively coupled with the first high-band patch radiating element;

a second low-band patch radiating element configured below and spaced apart from the first low-band patch radiating element and comprising an electrically conductive plane having an aperture for radiative coupling with low-band RF energy fed via at least one low-band feed that is configured on a dielectric sheet below and spaced apart from the second low-band patch radiating element; and a metallic perimeter structure, configured around the edges of said first and second high-band patch radiating elements, comprising at least first, second and third wall sections extending generally in the radiating direction, none of which wall sections extends generally perpendicular to the radiating direction, wherein said first wall section is configured with one end positioned in close proximity to said first high-band patch radiating element and the other end extending in the radiating direction is oriented away from said first high-band patch radiating element, wherein said second wall section is configured with one end coupled to the first wall section and the other end of said second wall section is oriented generally away from the radiating direction, and wherein said third wall section is configured with one end coupled to the second wall and the other end of said third section is oriented generally in the radiating direction and wherein the metallic perimeter structure has a cross section that is substantially in the shape of the letter "N" to form a continuous N-shaped wall and wherein at least two of the wall sections are angled relative to each other.

2. The antenna radiating structure as set out in claim 1, wherein said metallic perimeter structure is recessed from the top surface of said second patch radiating element.

3. The antenna radiating structure as set out in claim 2, wherein the third wall section extends further in the radiating direction than said first and second wall sections.

4. The antenna radiating structure as set out in claim 1, wherein said second high-band patch radiating element comprises a planar surface and wherein at least one of the wall sections has a planar surface oriented at an angle of a few degrees relative to a direction normal to the planar surface comprised by the second high-band patch radiating element.

5. The antenna radiating structure as set out in claim 4, wherein said first and third wall sections each have a planar surface oriented at an angle of a few degrees relative to the surface normal of said first patch radiating element and oriented away from the first patch radiating element and wherein said second wall section has a planar surface oriented at an angle of a few degrees relative to the surface normal of said first patch radiating element and oriented toward the first patch radiating element.

6. The antenna radiating structure as set out in claim 5, wherein the planar surfaces of said first and third wall sections are substantially parallel.

7. The antenna radiating structure as set out in claim 1, wherein the N-shaped wall has four sides around the perimeter of the first low-band patch radiating element, wherein the length of each side of the N-shaped wall measured in the direction parallel to the surface of the first low-band patch radiating element is approximately one half of a radiation emission wavelength of the first low-band patch radiating element.

8. The antenna radiating structure as set out in claim 1, further comprising a metallic partial enclosure having a cavity containing the first and second low-band patch radiating elements and wherein the height of the N-shaped wall in the radiating direction is in the range of approximately 0.5 to approximately 0.75 of the distance of said first low-band patch radiating element above the bottom of said cavity.

9. The dual band antenna radiating structure as set out in claim 1, wherein one of the dual bands is in the range of approximately 700 MHz to approximately 900 MHz.

10. A dual band antenna radiating structure, comprising:

a low-frequency patch antenna structure comprising a first low-frequency generally planar radiating element comprising an electrically conductive plane having an aperture for radiative coupling with low-band RF energy fed via at least one low-band feed configured on a dielectric sheet below and spaced apart from the first low-frequency generally planar radiating element, and a second low-frequency generally planar radiating element configured above and spaced apart from said first low-frequency generally planar radiating element in the radiating direction;

a high-frequency patch antenna structure comprising a first high-frequency generally planar radiating element and a second high-frequency generally planar radiating element configured above and spaced apart from said first high-frequency generally planar radiating element in the radiating direction, wherein at least part of said high-frequency patch antenna structure is positioned above said low frequency patch antenna structure in a radiating direction;

a metallic perimeter structure, configured around the edges of said low-frequency patch antenna structure, including one or more walls oriented at an angle that is other than generally perpendicular to the radiating direction, and wherein said metallic perimeter is substantially in the shape of the letter "N" to form an N-shaped wall; and a metallic partial enclosure having a high-frequency cavity containing the first and second high-frequency generally planar radiating elements and a low-frequency cavity containing the first and second low-frequency generally planar radiating elements, wherein said high-frequency cavity extends partially into said low-frequency cavity.

11. The dual band antenna radiating structure as set out in claim 10, wherein said metallic perimeter structure is below the top surface of said second high-frequency generally planar radiating element.

12. The dual band antenna radiating structure as set out in claim 11, wherein said metallic perimeter structure comprises at least first, second and third wall sections extending generally in the radiating direction and wherein at least two of the wall sections are angled relative to each other.

13. The dual band antenna radiating structure as set out in claim 10, wherein one of the dual bands is a low-frequency band in the range of approximately 700 MHz to approximately 900 MHz and wherein the other of the dual bands is in a high-frequency band in the range of approximately 1.7 GHz to 2.2 GHz.

14. An antenna array, comprising:

a ground plane;

first and second dual band antenna structures coupled to the ground plane, each comprising:

a low-frequency patch antenna structure comprising a first low-frequency generally planar radiating element comprising an electrically conductive plane having an aperture for radiative coupling with low-band RF energy fed via at least one low-band feed configured on a dielectric sheet below and spaced apart from the first low-frequency generally planar radiating element, and a second low-frequency generally planar radiating element configured above and spaced apart from said first low-frequency generally planar radiating element in the radiating direction;

a high-frequency patch antenna structure comprising a first high-frequency generally planar radiating element and a second high-frequency generally planar radiating element configured above and spaced apart from said first high-frequency generally planar radiating element in the radiating direction, wherein at least part of said high-frequency patch antenna structure is positioned above said low frequency patch antenna structure in a radiating direction; and a metallic perimeter structure, configured around the edges of said low-frequency patch antenna structure, including one or more walls oriented at an angle that is other than generally perpendicular to the radiating direction, and wherein said metallic perimeter is substantially in the shape of the letter "N" to form an N-shaped wall; and a high band antenna structure configured on the ground plane between said first and second dual band antenna structures, the high band antenna structure comprising a first high-band patch radiating element that comprises an electrically conductive plane for radiative coupling with high-band RF energy fed via at least one high-band feed located below the first high band patch and a second high-band patch radiating element configured above and spaced apart from said first high-band patch radiating element in a radiating direction, the second high-band patch radiating element comprising a secondary radiating patch.

* * * * *